United States Patent [19]

Pusateri et al.

[11] 4,251,707

[45] Feb. 17, 1981

[54] INDUCTOR FOR AXIALLY AND CIRCUMFERENTIALLY HEATING A ROTATING WORKPIECE

[75] Inventors: James J. Pusateri; James R. Masie, both of Cleveland, Ohio

[73] Assignee: Park-Ohio Industries, Inc., Cleveland, Ohio

[21] Appl. No.: 65,082

[22] Filed: Aug. 9, 1979

[51] Int. Cl.[3] ..... H05B 6/36

[52] U.S. Cl. ..... 219/10.79; 219/10.57

[58] Field of Search ..... 219/10.79, 10.75, 10.57, 219/10.49, 10.51, 10.43, 9.5, 8.5, 7.5, 6.5

[56] References Cited

U.S. PATENT DOCUMENTS

| | | | |
|---|---|---|---|
| 2,781,438 | 2/1957 | Griffith, Jr. | 219/10.79 |
| 2,797,288 | 6/1957 | Kiemele et al. | 219/10.79 X |
| 3,827,275 | 8/1974 | Suttan et al. | 219/10.79 X |
| 3,846,609 | 11/1974 | Enk | 219/10.79 |
| 3,848,107 | 11/1974 | Lewis | 219/10.79 |
| 4,100,387 | 7/1978 | Reinke et al. | 219/10.79 X |

FOREIGN PATENT DOCUMENTS

| | | | |
|---|---|---|---|
| 544686 | 2/1977 | U.S.S.R. | 219/10.79 |

*Primary Examiner*—B. A. Reynolds
*Assistant Examiner*—Philip H. Leung
*Attorney, Agent, or Firm*—Meyer, Tilberry & Body

[57] ABSTRACT

An inductor coil is provided for inductively heating a hollow automotive front wheel spindle which has axially extending outer surface areas of different radial thickness. The coil has a single loop between the terminal ends thereof defined by circumferentially extending arcuate inductor portions which are axially spaced apart and connected with one another by means of axially extending inductor portions. The arcuate inductor portions are circumferentially progressive with respect to one another in the direction from one of the terminal ends of the inductor toward the other, and each arcuate portion is associated with a different one of the axially extending surface portions of the workpiece. Each arcuate portion has a circumferential extent different from the other two. Upon energization of the inductor and rotation of the workpiece relative thereto, the axial sections of the workpiece having different radial thicknesses and diameters are inductively heated to provide a uniform depth of the heating pattern axially of the workpiece.

16 Claims, 7 Drawing Figures

INDUCTOR FOR AXIALLY AND CIRCUMFERENTIALLY HEATING A ROTATING WORKPIECE

BACKGROUND OF THE INVENTION

The present invention relates to the art of induction heating and, more particularly, to an inductor for use in connection with the induction hardening of metal workpieces.

The inductor of the present invention finds particular utility in connection with the heating and hardening of hollow automotive wheel spindles having axially extending sections of different radial thickness, and the invention will be disclosed and described in detail herein with regard to such a workpiece. At the same time, however, it will be appreciated that the present invention is applicable to the induction heating of workpieces other than wheel spindles and is applicable, in general, to workpieces having axially extending surface portions of different dimensions laterally of the surface and with respect to which it is desired to achieve a uniform depth of heating along the axial surface.

As is well known, an automobile wheel spindle is a tubular metal member having an axially extending outer surface which is adapted to receive and support wheel bearing components and a vehicle wheel. Such a spindle has axially adjacent areas in which the outer surface is radially stepped, whereby the radial wall thickness of the spindle varies from one axial section to the next. For well known reasons, it is necessary to harden the axially extending outer surfaces of the spindle, such as by inductively heating the spindle and then flowing a quenching liquid onto the heated surface. Such a spindle additionally includes a flange extending radially outwardly from the inner end of the axially extending surface portion of the spindle, and it is also necessary to extend the area of hardening from the inner end of the axially extending surface portion radially outwardly a short distance into the flange.

Inductors heretofore employed in connection with the induction hardening of such spindles, and other workpieces having surface variations of the character providing different workpiece dimensions transverse to the outer surface, have not enabled achieving a uniform depth of the heating pattern inwardly of the outer surface from one axial section of the workpiece to the next, and/or have not enabled induction heating of the workpiece to be achieved efficiently. In this respect, for example, certain inductors heretofore provided have been inclined relative to the total axial length of the surface to be hardened and this relationship, for each axial section, provides for the inductor to be closer to the workpiece at one end of the axial section than at the other end. Accordingly, when the inductor is magnetically coupled with the workpiece the air gap between the inductor and workpiece varies along the length of a given axial section of the workpiece, whereby the depth of the heat pattern is greater at one end of the axial section than the other. Other efforts have included scanning the workpiece with an inductor coil having a fixed diametrical relationship with respect to the workpiece. While this may provide for a desired depth of heat pattern along one axial section of the workpiece, the several axial sections are radially stepped relative to one another. Thus, the air gap from one section to the next will change and the depth of the heat pattern in adjacent sections will vary accordingly. Another problem encountered in connection with obtaining a uniform depth of heat pattern results from the fact that the different axial sections of the workpiece have different circumferences. Thus, a given speed of relative rotation between the inductor and workpiece to achieve the desired depth of heat pattern in one section will not provide the same depth in the other sections which have a different circumference from the one section.

SUMMARY OF THE INVENTION

In accordance with the present invention, an inductor is provided for inductively heating a workpiece having axial sections of different radial dimensions, to more effectively and more efficiently achieve a uniform depth of the heat pattern along the length of the workpiece than was heretofore possible. This is achieved in accordance with the present invention by providing an inductor having axially stepped circumferentially extending arcuate portions each corresponding to one of the axially extending workpiece sections. The arcuate portions are connected in series with one another between terminal ends of the inductor, and when magnetically coupled with the corresponding workpiece section provide for the several workpiece sections to have a uniform depth of heating circumferentially and axially therealong in response to relative displacement between the inductor and workpiece. Further in this respect, each arcuate extending portion has a circumferential extent determined by the outside diameter and radial thickness of the corresponding section of the workpiece. Thus, rotation of the workpiece at a given speed and for a given time assures appropriate flux densities in the different sections for the desired uniform heating. In accordance with a preferred embodiment, the arcuate inductor portions are axially spaced apart and circumferentially oriented relative to one another to completely encircle a workpiece, and the arcuate portions are connected to one another in series by axially extending leg portions. Therefore, when the workpiece is disposed within the enclosing inductor and rotated relative thereto, the arcuate portions and leg portions together provide the desired flux densities for the corresponding workpiece sections.

It is accordingly an outstanding object of the present invention to provide an inductor for inductively heating a workpiece having axial sections of different radial dimensions such that a uniform depth of heat is achieved circumferentially and axially of the workpiece.

Another object is the provision of an inductor of the foregoing character having inductor portions each corresponding to a different one of the axial sections of the workpiece and dimensionally related thereto in a manner which provides a uniform depth of heat pattern along all workpiece sections upon energization of the inductor at a given power level.

Yet another object is the provision of an inductor of the foregoing character comprised of a plurality of circumferentially extending arcute inductor portions axially spaced apart and connected to one another in series and in which each arcuate portion has a circumferential extent less than 360°.

A further object is the provision of an inductor of the foregoing character in which the arcuate inductor portions are circumferentially progressive with respect to the direction from one terminal end of the inductor to the other and together provide an inductor which is circumferentially enclosing with respect to a workpiece to be heated.

Still a further object is the provision of an inductor of the foregoing character which is extremely efficient in connection with the induction heating of a workpiece having axially extending surface portions of different radial dimension, and extremely effective with respect to obtaining a uniform depth of heat pattern axially along the workpiece from one axial section thereof to the next.

BRIEF DESCRIPTION OF THE DRAWINGS

The foregoing objects, and others, will in part be obvious and in part pointed out more fully hereinafter in conjunction with the written description of a preferred embodiment of the invention shown in the accompanying drawings in which.

DESCRIPTION OF A PREFERRED EMBODIMENT

Figure 1:
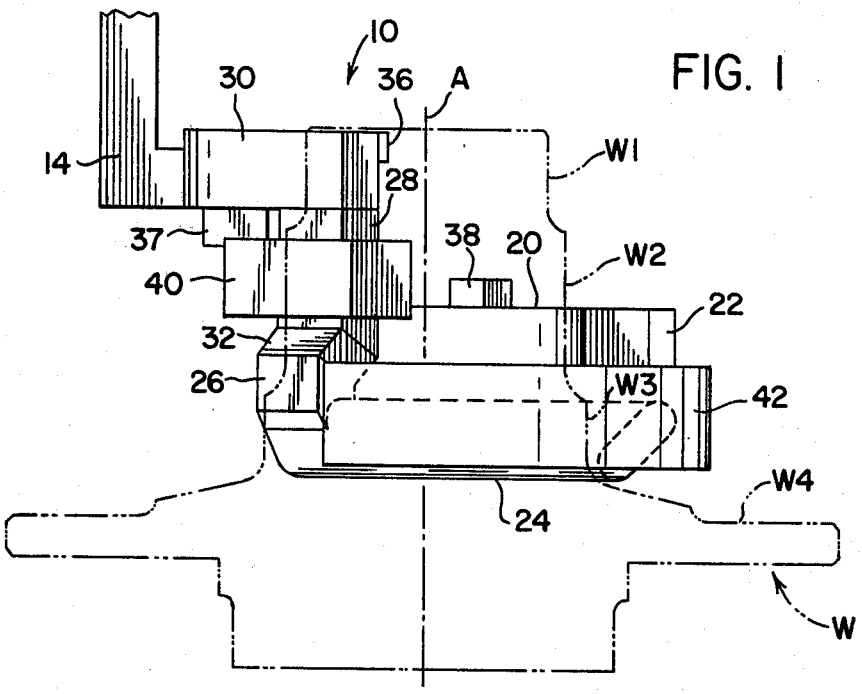
FIG. 1 is a side elevation view of an inductor constructed in accordance with the present invention and showing the inductor associated with a workpiece to be heated.
Figure 2:
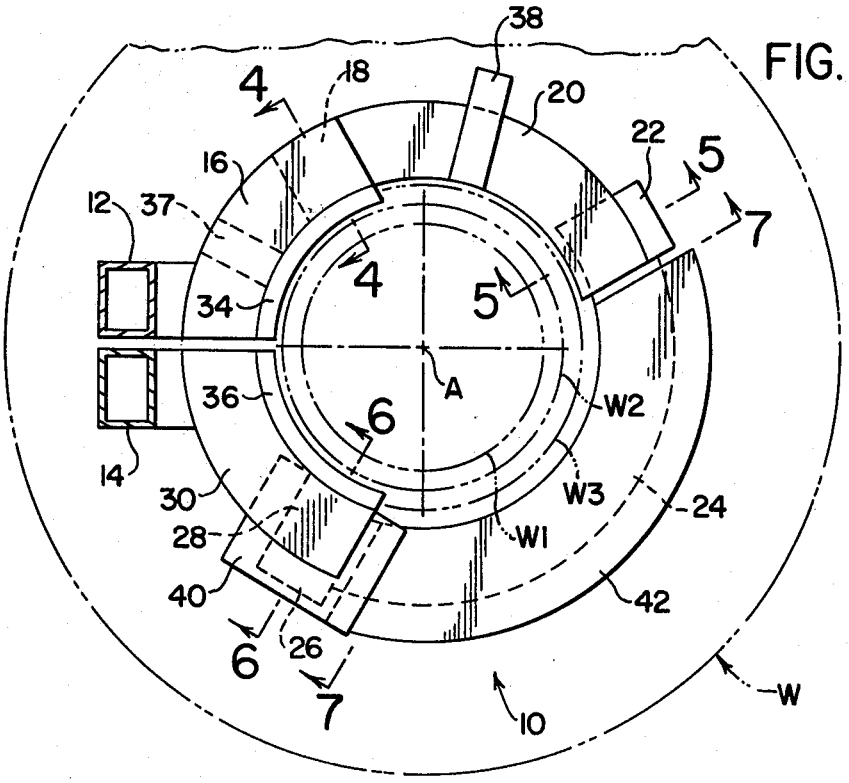
FIG. 2 is a plan view of the inductor and workpiece.
Figure 7:
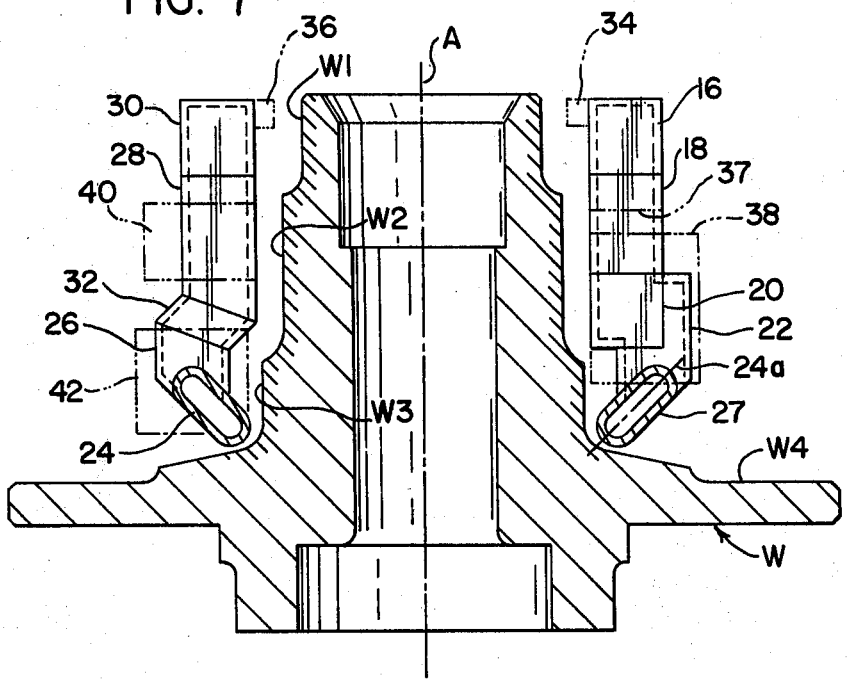

Referring now in greater detail to the drawings wherein the showings are for the purpose of illustrating a preferred embodiment of the invention only and not for the purpose of limiting the invention, an inductor 10 constructed in accordance with the present invention is illustrated in FIGS. 1 and 2 in association with a workpiece W having axially adjacent outer surface portions of different radial dimension. In the embodiment disclosed, the workpiece is an automobile wheel spindle which, as best seen in FIG. 7, has an axis A and axially extending outer surface portions W1, W2 and W3 between the axially outer end of the spindle and a radially outwardly extending flange W4 at the inner end of the spindle. It will been seen that the axially extending surface portions W1, W2 and W3 are radially stepped outwardly with respect to one another and with respect to the inner surface of the workpiece as defined by the spindle bore, whereby each of the outer surface portions is associated with an axial portion of the workpiece which has a radial dimension different from that of the adjacent workpiece portion.

In connection with the use of the wheel spindle, it is necessary to harden the outer surface circumferentially and axially from the outer end of the spindle into the radial flange thereof, and to obtain a radial depth of hardness which is uniform througout the axial extent of the outer surface of the workpiece. As will become more apparent hereinafter, this is achieved in the preferred embodiment shown by positioning a workpiece W coaxially within inductor 10, energizing the inductor and rotating the workpiece relative thereto to inductively heat the outer surface of the workpiece circumferentially and axially. After the workpiece is inductively heated in this manner, a suitable quenching liquid is flowed onto the heated surface to harden the latter. It will be appreciated, of course, that suitable apparatus will be provided for positioning workpiece W relative to the inductor, rotating the workpiece relative to the inductor, and quench hardening the heated workpiece. Apparatus for these purposes is well known in the art, is not necessary to provide an understanding of the present invention and, accordingly, is not illustrated.

In connection with inductively heating the outer surface portions of workpiece W, the radially thicker portions of the spindle draw heat radially inwardly away from the corresponding outer surface of the spindle faster than the heat is drawn radially inwardly in the radially thinner portions of the spindle, thus making it extremely difficult in an induction hardening process to uniformly heat the axially adjacent outer surface portions of the spindle. In accordance with the preferred embodiment of the invention herein illustrated, uniformity of the depth of the heat pattern axially along the outer surface of the spindle is achieved by a unique inductor structure and configuration. In this respect, the inductor is comprised of portions each associated with a corresponding portion of the workpiece and operable to induce a current density in the corresponding workpiece portion in relation to the radial dimension thereof.

Figure 3:
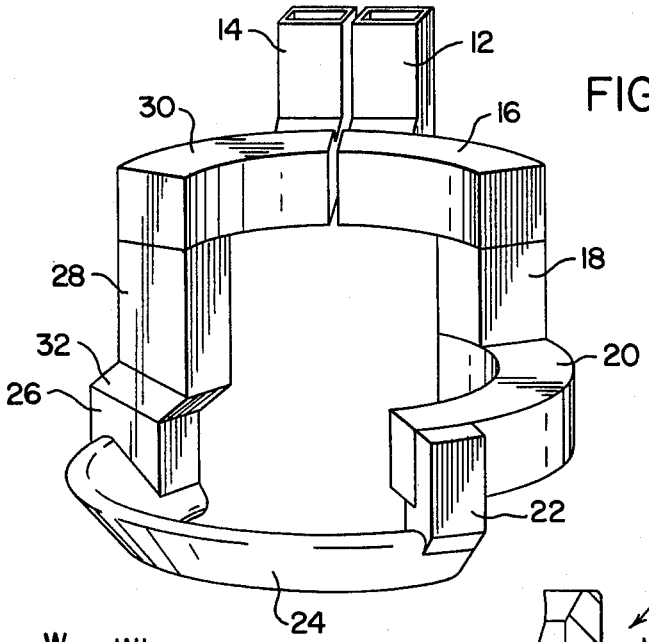
FIG. 3 is a perspective view of the inductor.
Figure 4:
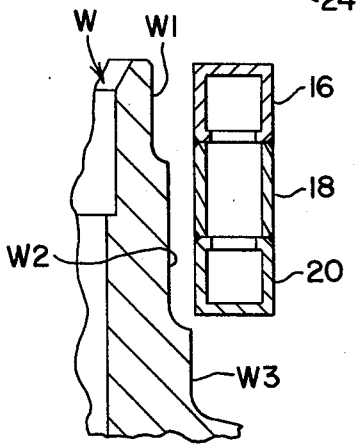
FIG. 4 is a sectional elevation view of the inductor and workpiece taken along line 4—4 in FIG. 2.
Figure 5:
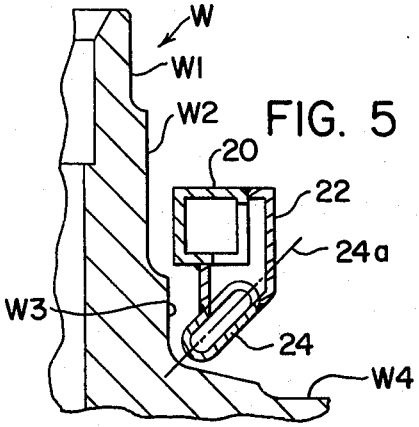
FIG. 5 is a sectional elevation view of the inductor and workpiece taken along lines 5—5 in FIG. 2.
Figure 6:
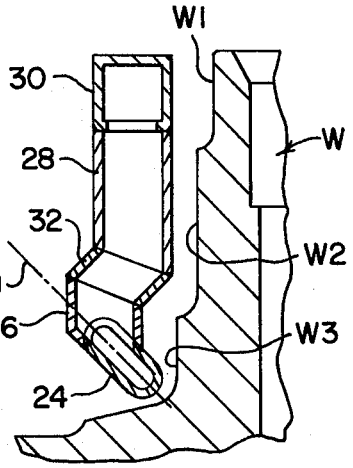
FIG. 6 is a sectional elevation view of the inductor and workpiece taken along line 6—6 in FIG. 2; and, FIG. 7 shows the workpiece in vertical section and the inductor portions of FIGS. 4, 5 and 6 oriented relative to the axis of the workpiece so as to illustrate the effective axial relationship between the inductor portions and workpiece.

As best seen in FIGS. 1–3, inductor 10 is an enclosing inductor having a circumferential extent of 360° with respect to workpiece W when the latter is positioned within the inductor for heating. The inductor and workpiece are coaxial when so positioned, and the inductor is axially tiered so as to provide a number of arcuate inductor portions in axially spaced apart parallel planes and connected in series with one another to provide the inductor loop. More particularly, in the embodiment disclosed inductor 10 is of tubular construction having terminal ends 12 and 14 which are adapted, in a well known manner, to be connected across a source of alternating current for energization of the inductor and to a source of cooling fluid for circulation of the latter through the inductor. The inductor is comprised of a number of circumferentially and axially extending conductor portions connected in series with one another between terminal ends 12 and 14 and oriented relative to one another for the circumferentially extending segments to be circumferentially progressive in the direction from one of the terminal ends to the other. More particularly in this respect, the inductor includes a first arcuate conductor portion 16 extending circumferentially from terminal end 12, a first leg portion 18 extending axially from arcuate portion 16, a second arcuate portion 20 extending circumferentially from leg 18, a second leg portion 22 extending axially from arcuate portion 20, a third arcuate portion 24 extending circumferentially from leg 22, third and fourth leg portions 26 and 28 extending axially from arcuate portion 24, and a fourth arcuate portion 30 coplanar with portion 16 and extending circumferentially between leg 28 and terminal end 14. As seen in FIG. 2, and for the purpose set forth more fully hereinafter, arcuate portions 16 and 30 together provide an arcuate inductor portion having a circumferential extent of about 120° with respect to axis A between the axes of leg portions 18 and 28. Arcuate portion 20 has a circumferential extent of about 90° between the axes of legs 18 and 22, and arcuate portion 24 has a circumferential extent of about 150° between the axes of legs 22 and 26.

As will be seen from FIGS. 2 and 4–6, when workpiece W is positioned within inductor 10 arcuate conductor portions 16 and 20 extend circumferentially of workpiece surface portion W1 in radially spaced relationship therewith and have an axial dimension generally corresponding to that of surface portion W1. It will be further seen from these Figures that leg portions 18 and 28 extend axially along the upper end of surface portion W2, that arcuate portion 20 extends circumferentially about the lower end of surface portion W2, and that transition area 32 between leg segments 26 and 28 extends axially along the lower end of surface portion W2. Finally, it will be seen from these Figures that leg portions 22 and 26 extend axially along workpiece surface portion W3, and that arcuate portion 24 extends circumferentially about surface portion W3 in radially spaced relationship therewith. It will be noted at this point that the tubular conductor providing arcuate portion 24 is oval in cross-sectional configuration, having a major axis 24*a* inclined at an angle of about 45° with respect to axis A and intersecting the workpiece in the outwardly curving root area between surface portion W3 and flange W4.

When workpiece W is positioned within inductor 10 the several conductor portions are magnetically coupled with corresponding portions of the workpiece and are cooperable to inductively heat the outer surfaces of the axially adjacent workpiece portions and the root area upon energization of the inductor and rotation of workpiece W relative thereto. The axial relationship of the conductor portions relative to the workpiece during an induction heating operation is shown in FIG. 7 of the drawing, and the circumferential relationships will be apparent from FIG. 2 of the drawing. A uniform depth of the heating pattern circumferentially and axially of the workpiece is achieved in that the arcuate and axial conductor portions provide for the flux density between the conductor portions and corresponding portions of the workpiece to vary in accordance with the radial thickness and diameter dimensions of the corresponding workpiece portion. Thus, it will be appreciated that arcuate conductor portions 16 and 30 have a circumferential extent relative to axis A and an air gap relative to surface portion W1 which, for a given power input to the inductor and scanning time by rotation of the workpiece inductively heats workpiece portion W1 circumferentially and axially to provide a desired depth of heating pattern as illustrated by cross-hatching in FIG. 7. It will likewise be appreciated that the circumferential extent of arcuate portion 20 together with axial leg portions 18 and 28 and the corresponding air gap relative to surface W2 provide the desired depth of heating pattern along workpiece portion W2, and that arcuate portion 24 has a circumferential extent and air gap relative to the workpiece which, together with axial legs 22 and 26 and their respective air gaps, provides for achieving the desired depth of heat pattern in workpiece portion W3 and the root area leading into flange W4, under the same power input and scanning time conditions.

It will be appreciated in connection with the wheel spindle workpiece illustrated herein that, during induction heating of the outer surface thereof, heat is conducted away from the outer surface into the unheated areas of the workpiece, and that such conduction is at a faster rate in the radially thick portions of the workpiece than in the radially thin portions thereof. Accordingly, it will be appreciated that the circumferential extents of the arcuate portions of the inductor and the axial lengths of the leg portions, together with the air gaps between the conductor portions and workpiece will be such that the intensities of the magnetic fields induced in the axially adjacent workpiece portions will provide the desired uniform depth of heating in response to a given power input to the inductor and given rotational scanning time of the workpiece relative to the inductor. It will be further appreciated that the circumferential extents of the arcuate conductor portions, the axial lengths of the leg portions and the cross-sectional configurations of the conductor portions will vary depending on the outer surface configuration and radial dimensions of the workpiece. For example, the oval configuration of arcuate portion 24 and the disposition of the major axis thereof relative to the wokpiece axis is to achieve the desired uniform depth of heat pattern through the root or transition area between the axially extending outer surface and radial extending flange surface of the workpiece. If, for example, workpiece portion W3 were defined by an axially extending surface only, it will be appreciated that the arcuate portion of the inductor associated therewith would have a rectangular cross-sectional configuration similar to that of arcuate segments 16 and 20.

In connection with the preferred embodiment herein illustrated and described for use in connection with the induction heating of an automobile wheel spindle of the cross-sectional configuration shown, all of the tubular conductor portions except for arcuate portion 24 are defined by copper tubing which is square in cross-section having an outer dimension of ½ inch and a wall thickness of 0.062 inch. Arcuate conductor portion 24 is copper tubing having an outside dimension along the major axis of about ½ inch and a minor dimension transverse thereto of about ¼ inch, and a wall thickness of about 0.065 inch. As mentioned hereinabove, arcuate portions 16 and 30 each have a circumferential extent of 60°, arcuate portion 20 has a circumferential extent of 90° and arcuate portion 24 has a circumferential extent of 150°. Further, the inductor has an axial length from the top surface of arcuate portions 16 and 30 to the lowermost edge of arcuate portion 24 of 2.28 inches. The inner surfaces of arcuate portions 16, 20 and 30 and axial legs 18 and 28 have a radius of 1.12 inches with respect to axis A, and the innermost edge of arcuate portion 24 has a radius of 1.19 inches with respect to axis A. The inner surfaces of leg portions 22 and 26 are radially spaced from axis A 1.3 inches. Major axis 24*a* of arcuate portion 24 is inclined at an angle of 45° with respect to axis A. The foregoing dimensions are provided for an inductor for inductively heating an automotive wheel spindle having the cross-sectional configuration disclosed and manufactured by New Departure under part designation "E" Car Front Wheel Spindle, and Part No. 1350007.

In connection with the specific inductor structure and workpiece relationship described hereinabove, it is desirable to provide arcuate conductor segments 16 and 30 with circumferential coextensive copper sheet elements 34 and 36, respectively. Each of the elements has a radial thickness of about 0.12 inch and an axial length of 0.18 inch and the elements assure the desired depth of heating at the axially outer end of workpiece surface portion W1. In this respect, to facilitate construction of the inductor it is desirable to provide for arcuate segments 16 and 30 to have the same radius as that of arcuate segment 20 and axial leg segments 18 and 28. In view of the radially stepped relationship between workpiece surface portions W1 and W2, this like radius provides a larger air gap between the surfaces of segments 16 and 30 and workpiece surface W1 than between the inner surfaces of arcuate segment 20 and axial leg segments 18 and 28 and workpiece surface portion W2. This difference in air gap is compensated for by the circumferential extent of arcuate segments 16 and 30 relative to workpiece portion W1, but to assure the desired depth of heat pattern at the very outer end of workpiece portion W1, plates 34 and 36 are provided so as to reduce the air gap and thus increase the heating adjacent the outermost end of the workpiece.

Likewise, it may be desirable with a given inductor configuration and workpiece to intensify the flux in certain portions or segments of the inductor in order to optimize obtaining the desired uniform depth of heat pattern along the workpiece. In the specific embodiment of the inductor described herein for inductively heating a hollow automobile wheel spindle, such flux intensifying is provided by circumferentially narrow flux intensifying members 37 and 38 on arcuate inductor portions 16 and 20, respectively, flux intensifier element 40 on axial leg portion 28, and a flux intensifying element assembly 42 mounted on and circumferentially coextensive with arcuate portion 24. While such flux intensifying is shown in connection with the preferred embodiment herein illustrated and described, it will be appreciated that the extent to which such intensifying is necessary or desirable will depend on the specific workpiece to be inductively heated and the circumferential and axial dimensions of the inductor segments in a given configuration of construction for the workpiece.

While considerable emphasis has been placed herein on a preferred inductor construction and workpiece to be inductively heated thereby, it will be appreciated that other inductor structures providing axial and circumferentially extending serially arranged conductor portions providing different magnetic field densities in connection with axial portions of a workpiece having different radial dimensions, to achieve uniform heating of the workpiece axially therealong, can be provided without departing from the principles of the present invention. For example, it will be appreciated that an inductor having two arcuate portions will be provided for inductively heating a workpiece having two outer surface portions rather than three. Further, it will be appreciated that the adjacent ends of axially offset arcuate portions could be directly connected to one another when the axial dimensions of the arcuate portions correspond to the axial dimensions of the corresponding workpiece portion to be heated. These and other changes as well as changes in the preferred embodiment disclosed herein will be apparent to those skilled in the art. Accordingly, it is to be distinctly understood that the foregoing descriptive matter is to be interpreted merely as illustrative of the present invention and not as a limitation.

I claim:

1. An inductor for inductively heating a rotating workpiece having an axis and external axial surface areas of different radial dimension, said inductor having an axis coaxial with said workpiece axis, terminal ends connectable across a source of alternating current, and a plurality of inductor portions electrically connected in series between said terminal ends, each said inductor portion corresponding to a different one of said external surface areas of said workpiece and being radially spaced from said inductor axis for magnetic coupling with the corresponding external surface area, said inductor portions incuding at least two circumferentially extending arcuate inductor portions each having first and second ends with respect to the direction from one of said terminal ends toward the other terminal end, the second end of one of said arcuate portions being circumferentially adjacent and axially offset with respect to the first end of the other of said arcuate portions, said arcuate portions being circumferentially progressive with respect to one another, and each said arcuate portion having a circumferential extent less than 360°.

2. An inductor according to claim 1, and flux concentrating means on at least one of said arcuate portions.

3. An inductor according to claim 1, wherein said inductor portions are of tubular construction for the circulation of coolant through said inductor.

4. An inductor according to claim 1, wherein said arcuate portions together have a circumferential extent of 360°.

5. An inductor according to claim 1, wherein said inductor portions are of tubular construction, one of said arcuate portions having an elongated contour in cross-section providing a major axis, and said major axis being inclined with respect to said inductor axis.

6. An inductor according to claim 1, wherein said inductor portions are of tubular construction, one of said arcuate portions having a radially inner wall parallel to said inductor axis and including means providing a radially stepped surface facing said inductor axis.

7. An inductor according to claim 1, wherein said arcuate portions include first, second and third arcuate portions axially offset with respect to one another and together having a circumferential extent of 360°.

8. An inductor for inductively heating a rotating workpiece having an axis and external axial surface areas of different radial dimensions, said inductor having an axis coaxial with said workpiece axis, terminal ends connectable across a source of power, and a plurality of inductor portions connected in series between said terminal ends, each said inductor portion corresponding to a different one of said external surface areas of said workpiece and being radially spaced from said inductor axis for magnetic coupling with the corresponding external surface area, said inductor portions including a plurality of axially spaced apart circumferentially extending arcuate inductor portions, said arcuate portions being circumferentially progressive with respect to one another in the direction from one of said terminal ends toward the other and each said arcuate portion having a circumferential extent less than 360°, and said inductor portions further including an axially extending connecting portion between circumferentially adjacent ends of said arcuate portions.

9. An inductor according to claim 8, wherein said plurality of arcuate portions together have a circumferential extent of 360°.

10. An inductor according to claim 9, wherein said inductor portions are of tubular construction for the circulation of coolant through said inductor.

11. An inductor according to claim 10, wherein said plurality of arcuate portions include first, second and third arcuate portions disposed in corresponding first, second and third axially spaced apart parallel planes, each said first, second and third arcuate portions having a circumferential extent different from the other two portions.

12. An inductor according to claim 11, wherein one of said first, second and third arcuate portions has an elongated tubular contour in cross-section providing a major axis, said axis being inclined with respect to said inductor axis.

13. An inductor according to claim 12, and flux concentrating means on said one arcuate portion between the circumferentially opposite ends thereof.

14. An inductor for inductively heating a rotating workpiece having an axis and axial surface areas of different radial dimensions, said inductor having an axis coaxial with said workpiece axis, terminal ends connectable across a source of power, and a plurality of inductor portions connected in series between said terminal ends, said inductor portions being of tubular construction for the circulation of coolant through said inductor, each said inductor portion corresponding to a different one of said surface areas of said workpiece and being radially spaced from said inductor axis for magnetic coupling with the corresponding surface area, said inductor portions including a plurality of axially spaced apart circumferentially extending arcuate inductor portions, said arcuate portions being circumferentially progressive with respect to one another in the direction from one of said terminal ends toward the other, each said arcuate portion having a circumferential extent less than 360° and said arcuate portions together having a circumferential extent of 360°, said plurality of arcuate portions including first, second and third arcuate portions disposed in corresponding first, second and third axially spaced apart parallel planes, each said first, second and third arcuate portions having a circumferential extent different from the other two portions, one of said first, second and third arcuate portions having an elongated tubular contour in cross-section providing a major axis, said axis being inclined with respect to said inductor axis, flux concentrating means on said one arcuate portion between the circumferentially opposite ends thereof, another of said first, second and third arcuate portions having a radially inner wall parallel to said inductor axis and including means providing a radially stepped surface facing said inductor axis, and said inductor portions further including an axially extending connecting portion between circumferentially adjacent ends of said arcuate portions.

15. An inductor according to claim 14, wherein said another and said one of said first, second and third arcuate portions are respectively in said first and third planes, said second plane being axially between said first and third planes.

16. An inductor according to claim 15, wherein said another of said arcuate portions is defined by a pair of arcuate segments each connected to a different one of said terminal ends of said inductor.

* * * * *